United States Patent [19]

Weldon

[11] 4,207,066

[45] Jun. 10, 1980

[54] RETRACTABLE GANTRY HEAT TREAT FURNACE

[75] Inventor: John F. Weldon, Birmingham, Mich.

[73] Assignee: Fire Rite, Inc., Detroit, Mich.

[21] Appl. No.: 945,763

[22] Filed: Sep. 25, 1978

[51] Int. Cl.[2] ..... F24J 3/00

[52] U.S. Cl. ..... 432/225; 432/137; 432/229; 432/241

[58] Field of Search ..... 432/137, 225, 229, 241

[56] References Cited

U.S. PATENT DOCUMENTS

| | | | |
|---|---|---|---|
| 2,559,595 | 7/1951 | Clark | 432/137 |
| 2,589,495 | 3/1952 | Hess et al. | 432/225 |
| 3,419,255 | 12/1968 | Cavel et al. | 432/199 |
| 3,459,410 | 8/1964 | Oban | 432/225 |
| 3,489,400 | 1/1970 | Spitzbart et al. | 432/137 |
| 3,591,152 | 7/1971 | Mills, Jr. | 432/247 |
| 3,732,066 | 5/1973 | Kipple et al. | 432/225 |

FOREIGN PATENT DOCUMENTS

| | | | |
|---|---|---|---|
| 1403490 | 8/1975 | United Kingdom | 432/225 |

*Primary Examiner*—John J. Camby

*Attorney, Agent, or Firm*—Cullen, Sloman, Cantor, Grauer, Scott & Rutherford

[57] ABSTRACT

A retractable gantry heat treat furnace includes an elongated refractory bed mounted upon a floor for supporting metal parts for heat treatment. A pair of spaced tracks are mounted upon the floor upon opposite sides of the bed and extend longitudinally outward from one end thereof. An upright bulkhead is mounted upon said floor at the other end of said bed transversely thereof. An upright furnace housing having a closed end and an open end is movably mounted upon the tracks and has a retracted load position outwardly of said bed and adapted to move to a closed position over and enclosing said bed and sealed against said bulkhead. A series of spaced inwardly directed burners are mounted upon and along the side walls of the housing in communication with the interior thereof and are adapted for energization when the housing is in a closed position. Layers of insulation are arranged upon the interior of the side, top and end walls and upon the interior walls of the bulkhead, said burners extending through said side wall layers of insulation.

23 Claims, 11 Drawing Figures

FIG. 10
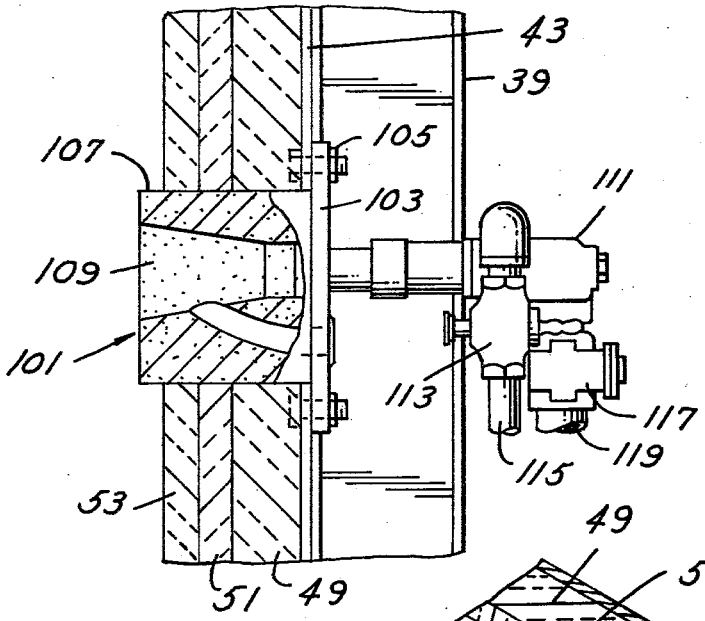
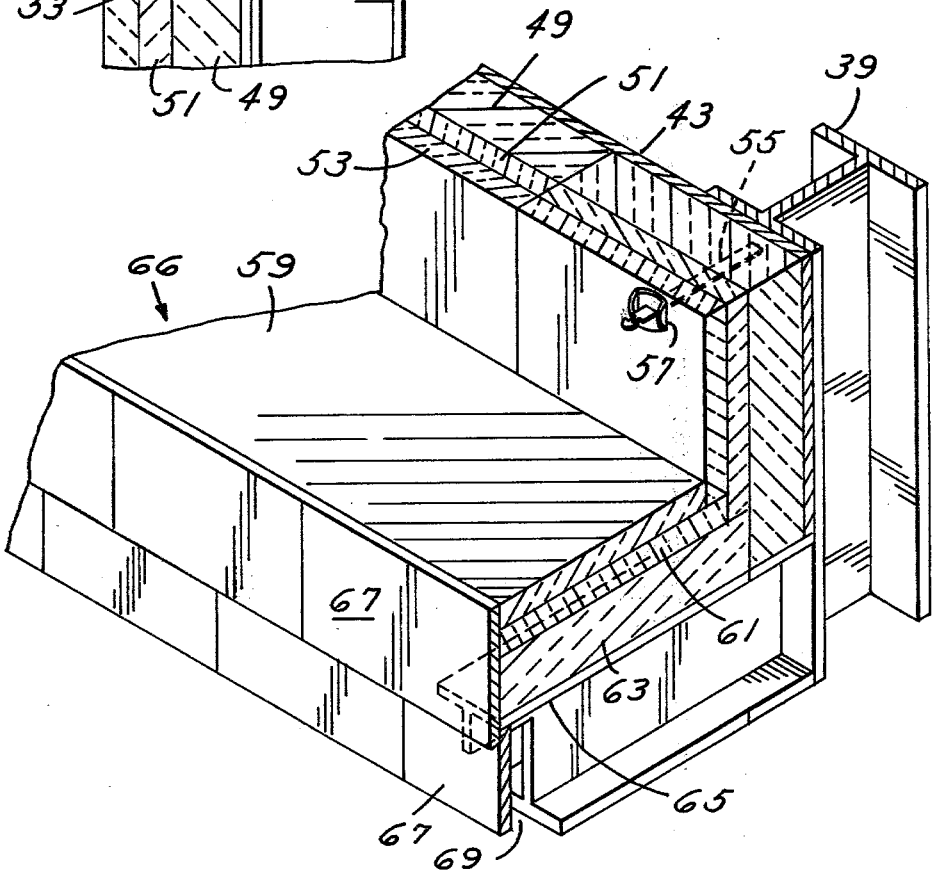
FIG. 11

RETRACTABLE GANTRY HEAT TREAT FURNACE

BACKGROUND OF THE INVENTION

Heretofore, in the use of heat treat furnaces and the like, the objects to be heat treated are usually mounted upon a platform or truck or car which is moved over the ground surface into a stationary furnace. There were certain hindrances and limitations in the use of rail cars and the like for supporting a work and subjecting the work, once loaded, to movement into a furnace. These included rail car deformation, wheel bearing failure, off-balance or motion-induced conditions.

Heretofore, it was necessary for personnel to enter the furnace before the heating and more time was involved in loading a car or vehicle with the workpieces before transporting same into such furnace. Examples of such prior art furnaces are shown in the following Patents: U.S. Pat. Nos. 631,414; 1,573,543; 2,502,828; 2,869,856; 3,489,400; 3,854,865.

SUMMARY OF THE INVENTION

It is an object of the present invention to provide a means for loading or the placement of weldments or other metal masses in a heat treat furnace without the limiting factors inherent in the traditional rail car used in a conventional furnace. The rail car is eliminated by a gantry furnace which travels over the work. Such a construction provides for a lower loading height from the floor and allows for more head room for overhead cranes.

It is an object of the present invention to provide a fixed rectangular refractory bed which may be mounted upon a plant floor and provided with rails upon opposite sides thereof with a fixed bulkhead at one end of the bed. The furnace has an insulated housing which is movably mounted on wheels over said tracks and, when retracted with respect to the bed, the bed may be loaded with metal objects to be heat-treated. Thereafter, the insulated furnace housing is moved into sealing registry with the bulkhead.

It is an object of the present invention to provide a means by which the loading of the work can be done directly onto the refractory bed without the limitations of the rail car and wherein, the work is not subject to movement when secure on the bed.

It is, therefore, a further object to provide a furnace height which can be reduced due to the elimination of the rail car and wherein, the furnace may be removed and repaired or relocated with a minimum of disruption of plant operation.

These and other objects will be seen from the following specification and Claims in conjunction with the appended drawings.

THE DRAWINGS

FIG. 10 is a fragmentary section taken in the direction of arrows 10—10 of FIG. 3, showing the burner construction on an increased scale as mounted upon the framework and through the side walls of the furnace housing.

FIG. 11 is a fragmentary section taken in the direction of arrows 11—11 of FIG. 2.

It will be understood that the above drawings illustrate merely a preferred embodiment of the invention, and that other embodiments are contemplated within the scope of the Claims hereafter set forth.

DETAILED DESCRIPTION OF THE INVENTION

Figure 1:
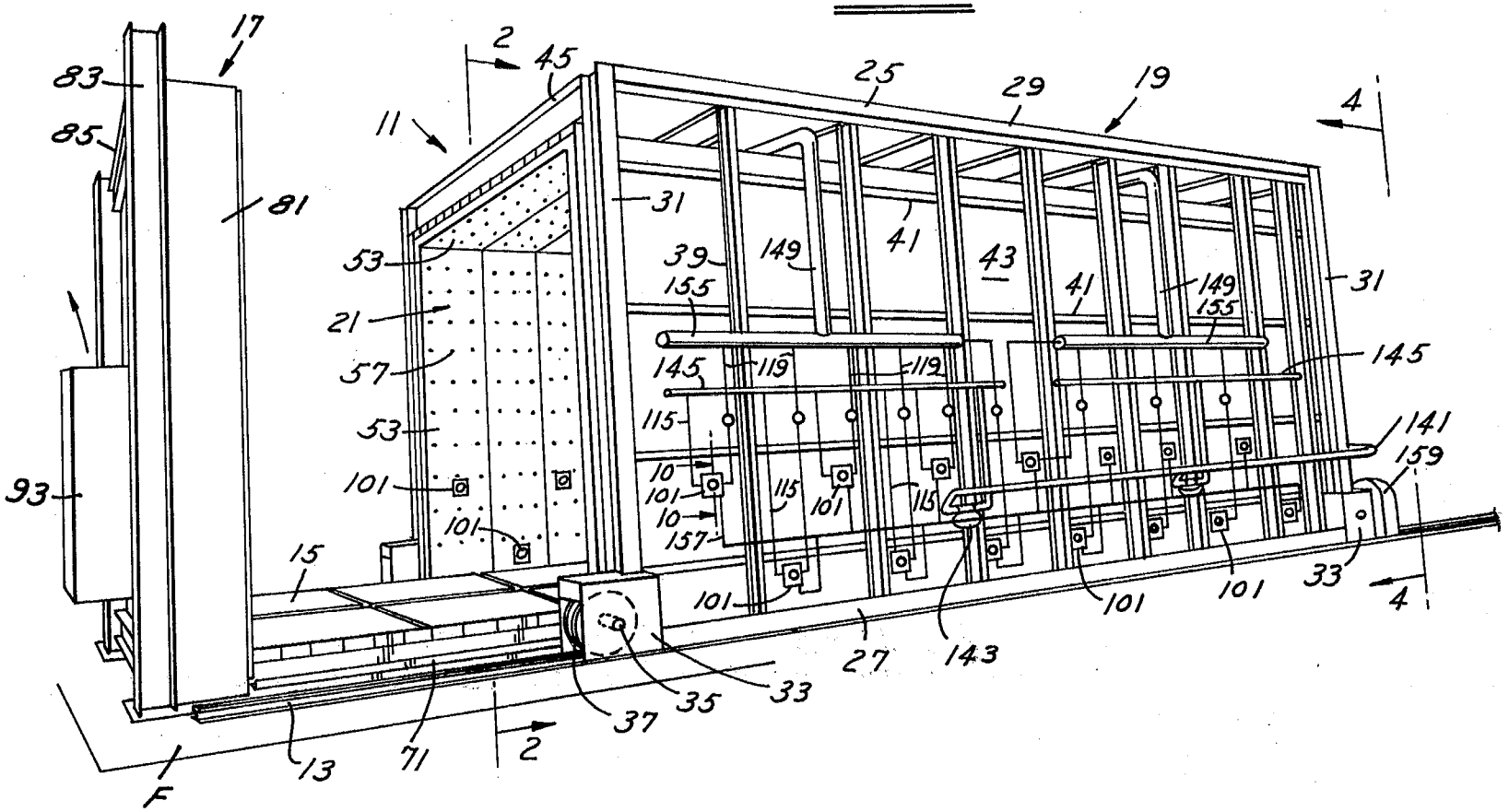
FIG. 1 is a front perspective view of the present gantry-type retractable heat treat furnace.

The present retractable gantry heat treat furnace is generally indicated at 11, FIG. 1, movably mounted upon rails 13 upon the floor surface F and arranged upon opposite sides of the elongated refractory bed 15 applied to said floor surface. At one end of said bed and transversely thereof is the stationary upright bulkhead 17.

Figure 4:
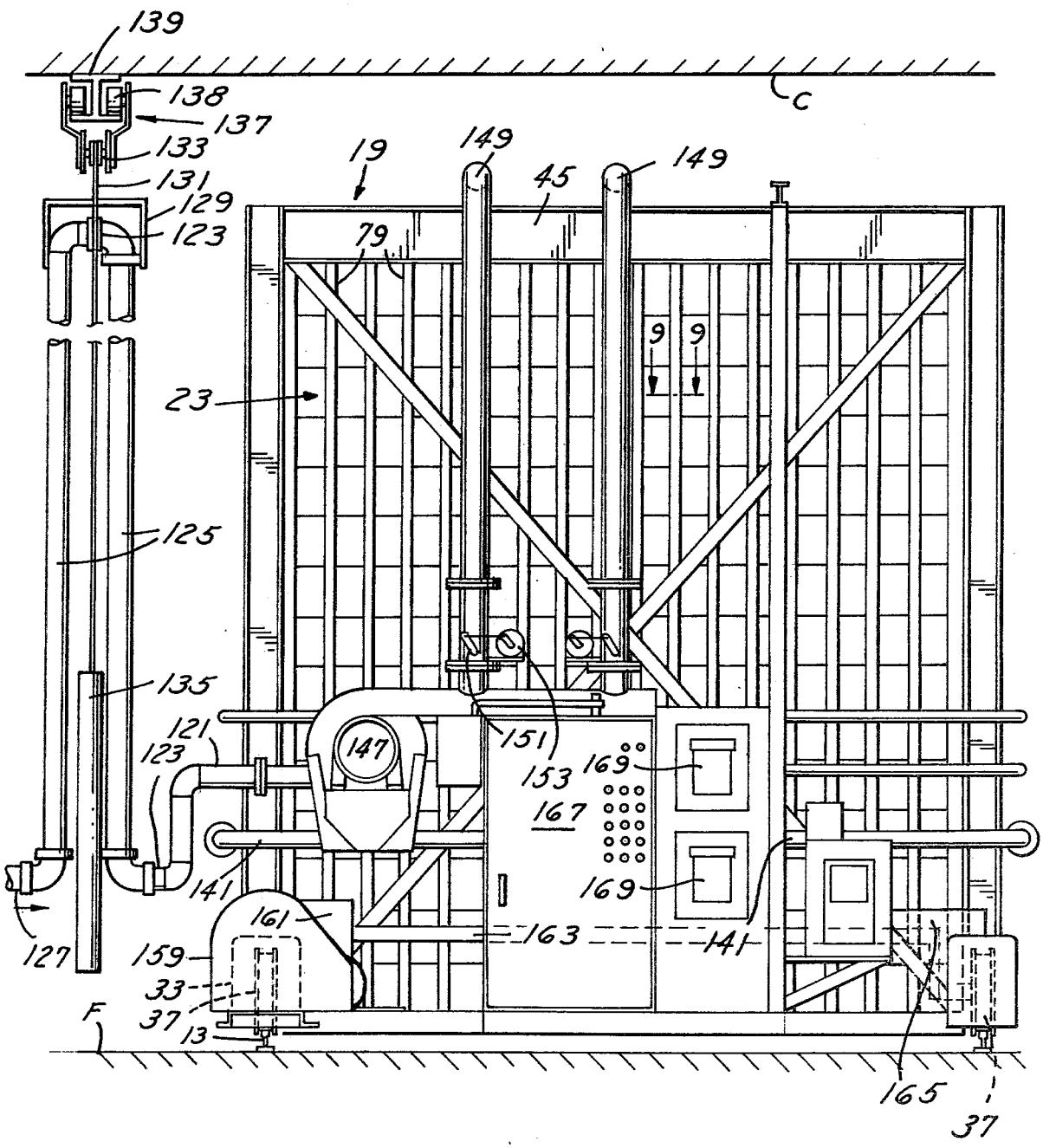
FIG. 4 is a rear elevational view of the furnace taken in the direction of arrows 4—4 of FIG. 1.
Figures 5, 6:
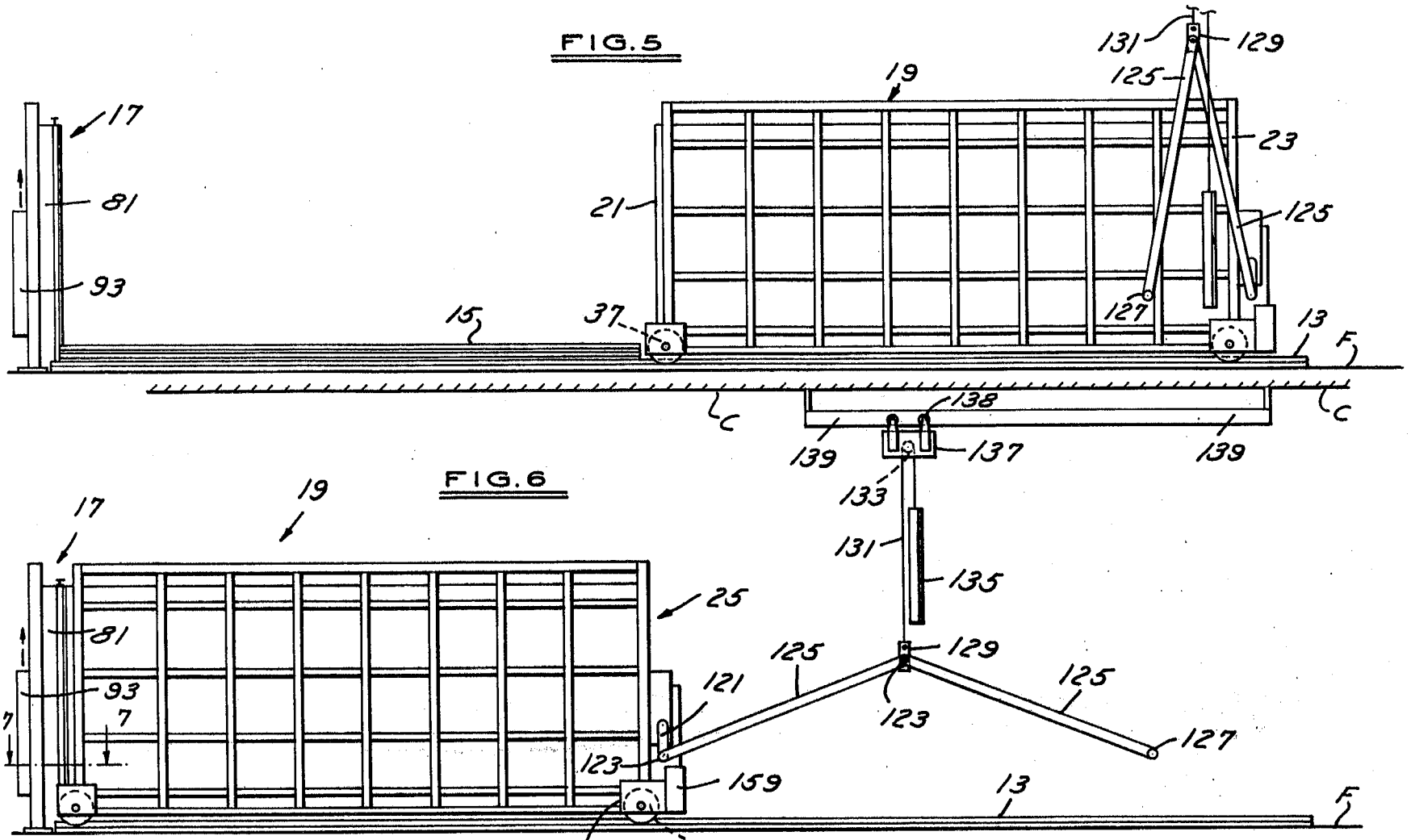
FIG. 5 is a fragmentary side elevational view of the furnace housing as retracted from the bulkhead.
FIG. 6 is a similar view, showing the furnace housing advanced upon the tracks in registry with the bulkhead.

The furnace includes the upright inverted U-shaped elongated furnace housing 19 having an open end 21 adapted for sealing registry with the bulkhead when in closed heat treat position, FIG. 6, and adapted for retraction of an open bed-loading position upon the rails 13 which extend longitudinally beyond said bed, FIGS. 1, 5 and 6. Said housing includes closed end 23, FIG. 4.

The retractable furnace housing has a framework 25, FIG. 1, which includes opposed pairs of longitudinally extending bottom and top beams 27 and 29. Said framework also includes, at its opposite ends and upon opposite sides, the upright I-beams 31. Incorporated into the framework are the opposed pairs of wheel housings 33 arranged on opposite sides of and at opposite ends of said framework suitably secured thereto as by welding. Each wheel housing includes a journal axle 35 for the corresponding channeled wheel 37 movably mounted upon the respective rails 13.

Said framework includes a series of longitudinally spaced inverted U-shaped support beams 39 and a series of vertically spaced reinforcing cross bars 41. Transverse horizontally disposed end beams 45 span the upper ends of upright beams 31 at opposite ends of said housing. The framework also includes as a part of the end wall for the housing a series of upright spaced I-beams 79. A series of parallel spaced longitudinally extending I-beams 47 underly the transverse top beams 45 forming a part of the top wall for the interior of said housing.

Accordingly, the gantry housing for the furnace includes upright side walls, an end wall and a top wall. These walls are formed by a layer of sheet steel 43 which bridges the respective U-shaped beams 39 and is suitably secured thereto, overlies and is secured to end wall beams 79 and underlies top wall beams 47, FIG. 3.

A suitable insulating surface is applied upon the interior of said housing over the side walls, the end walls, and the top wall. These insulated wall surfaces are accomplished by a first outer strip of predetermined thickness in the nature of a monobloc insulating blanket strip 49 which bears against the steel sheeting 43 as in FIG. 11.

Applied to the monobloc insulating strip 49 is an intermediate insulating blanket strip 51 of ceramic material which overlies the strip 49 and is of reduced thickness with respect to the strip 49. An inner upright ceramic insulation blanket strip 53 is also of reduced thickness and is applied to the intermediate strip 51 and is of higher density to withstand higher surface temperature.

Figure 9:
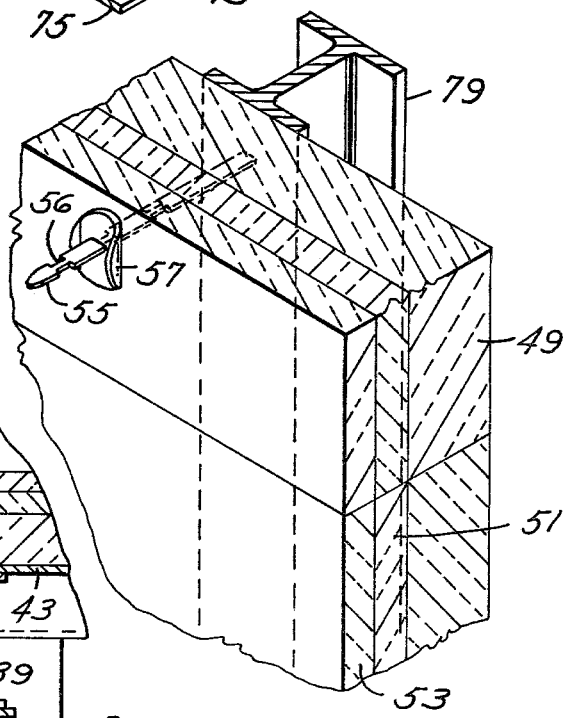
FIG. 9 is a fragmentary partly sectioned perspective view taken in the direction of arrows 9—9 of FIG. 4.

As shown in FIG. 11 and FIGS. 1, 2, 3 and 9, the respective upright insulating strips 49, 51 and 53 are secured to the corresponding sheet steel wall 43 as by a series of longitudinally spaced anchor clips 55 which have a series of notches 56 therein as shown in FIG. 9.

A formed lock washer 57 is applied over the end of the anchor clip and interlocks with one of the notches 56 to compressively and retainingly engage the respective insulating ceramic blanket strips.

Figure 2:
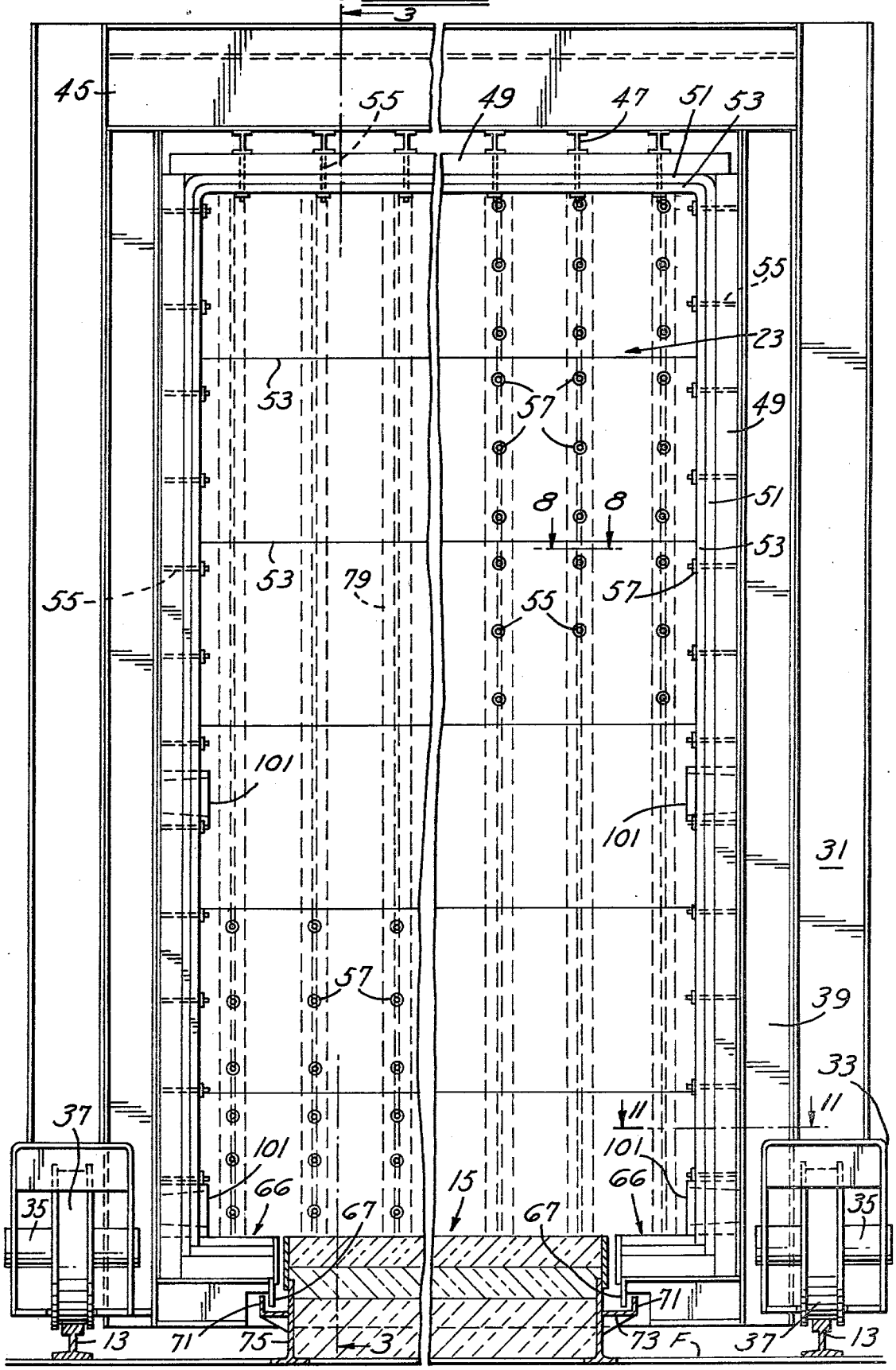
FIG. 2 is a vertical section taken in the direction of arrows 2—2 of FIG. 1, viewing the furnace housing from its open end.

At the lower ends of the side walls of the housing, as shown in FIGS. 2 and 11, there are provided a pair of inwardly directed bases 66 which extend inwardly toward the bed 15. These bases are also similarly insulated with the ceramic insulating strip 59, thereunder the ceramic insulating strip 61 and thereunder insulating strip or base block 63 overlying the transverse support beams 65.

Applied to the inner longitudinal edges of the bases 66 upon opposite sides of the refractory bed 15 are the upright edge plates 67 constructed preferably of stainless steel. The lower ends thereof are spaced from edge portions of the base 66 as by the clearance groove 69, FIG. 11.

Figure 8:
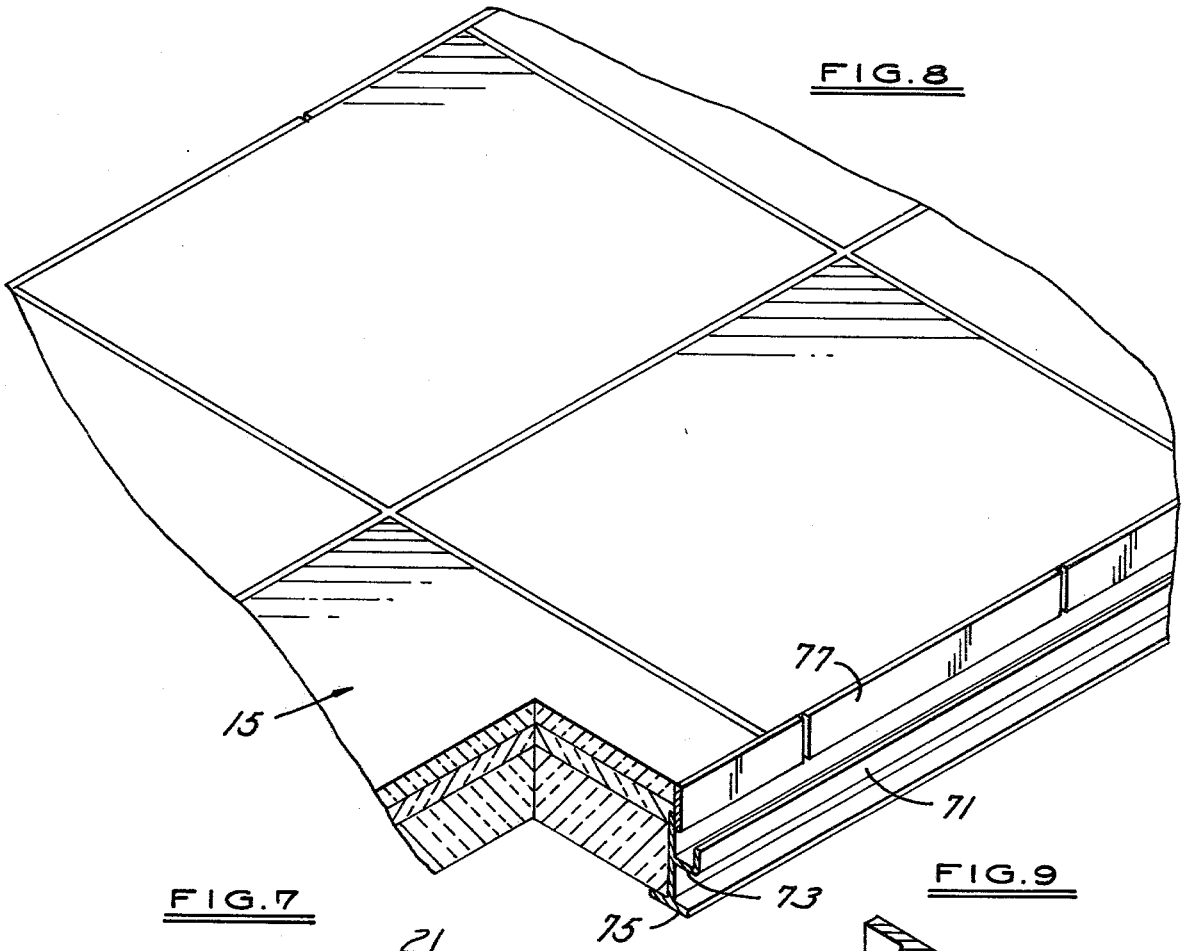
FIG. 8 is a fragmentary broken away perspective view of the furnace bed shown in FIG. 1.

As best shown in FIGS. 2 and 8, the refractory bed 15 consisting of layers of castable refractory brick has upon its opposite longitudinal sides support beams 75, the elongated upwardly opening channels 73 and the side plates 77 of stainless steel.

As shown in assembly in FIG. 2, and unassembled in FIG. 11, the inner edge plates 67 at their lower edges extend down into the channels 73 to provide a continuous seal between said bed and base portions 66 of the housing to substantially close off communication between the interior of the housing and the outside when the housing has been returned to use position, FIG. 6, in registry with the bulkhead 17. Upon retraction of said housing, the side plates 67 are adapted to move along and are spaced within channels 73 upon opposite sides of the refractory bed.

The upright stationary bulkhead 17, FIGS. 1, 3, 5, 6, and 7, have opposed upright sides 81, including upright support beams 83 and transverse top beam 85. Accordingly, said bulkhead includes sides walls 81, a top wall 97 and an end wall, of the same construction as the side walls, top wall and end wall of the retractable housing. Each of the walls except the bulkhead end wall includes the steel sheeting 43. The respective layers of insulating strips 49, 51 and 53 are horizontally disposed throughout the height of the back wall, the side walls 81 as well as the top wall shown in FIG. 3, utilizing a series of longitudinally spaced rows of anchor clips 55 and corresponding lock washers 57.

Figure 3:
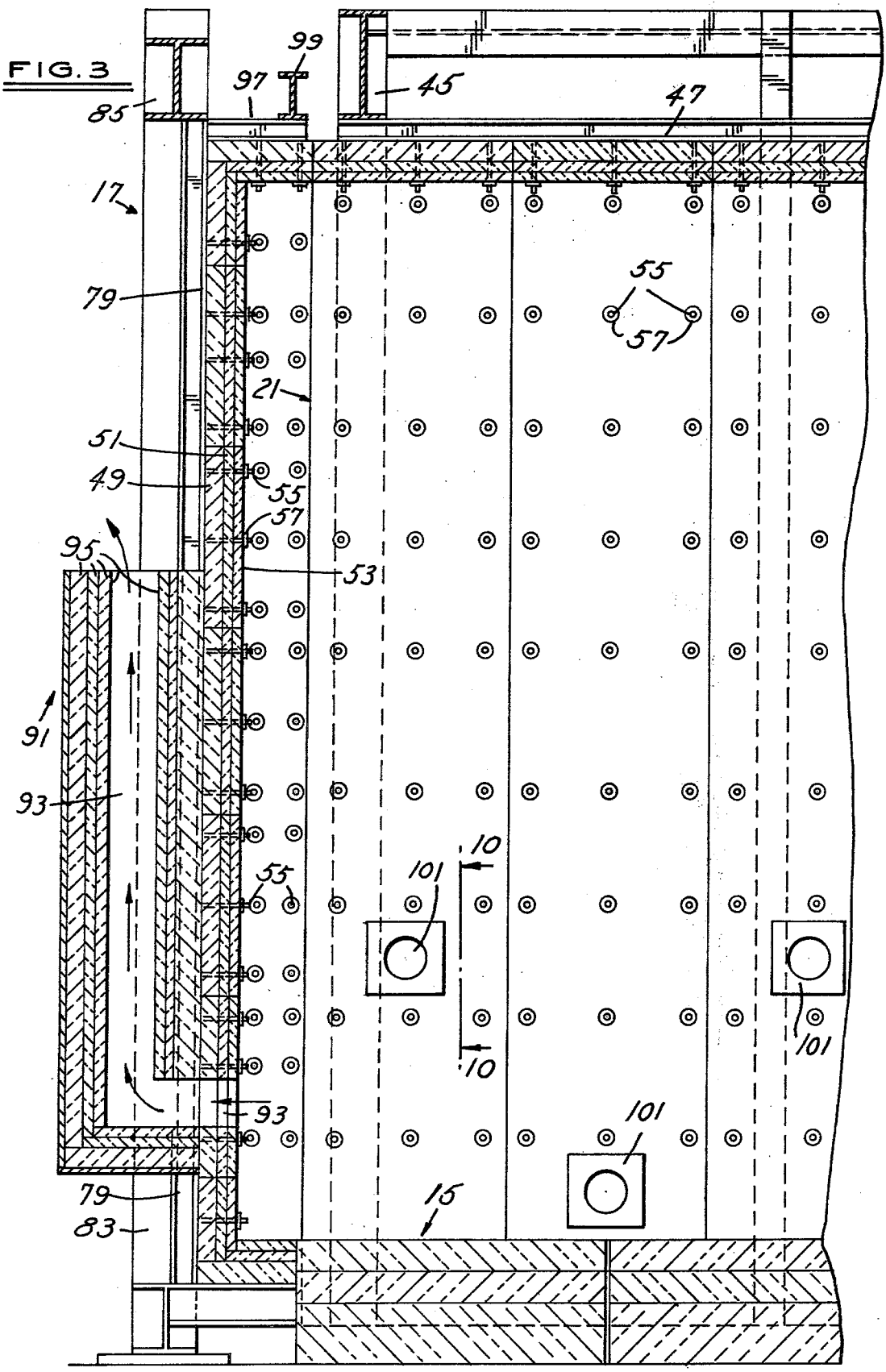
FIG. 3 is a vertical section taken in the direction of arrows 3—3 of FIG. 2, illustrating the open end of the furnace housing in registry with the bulkhead.
Figure 7:
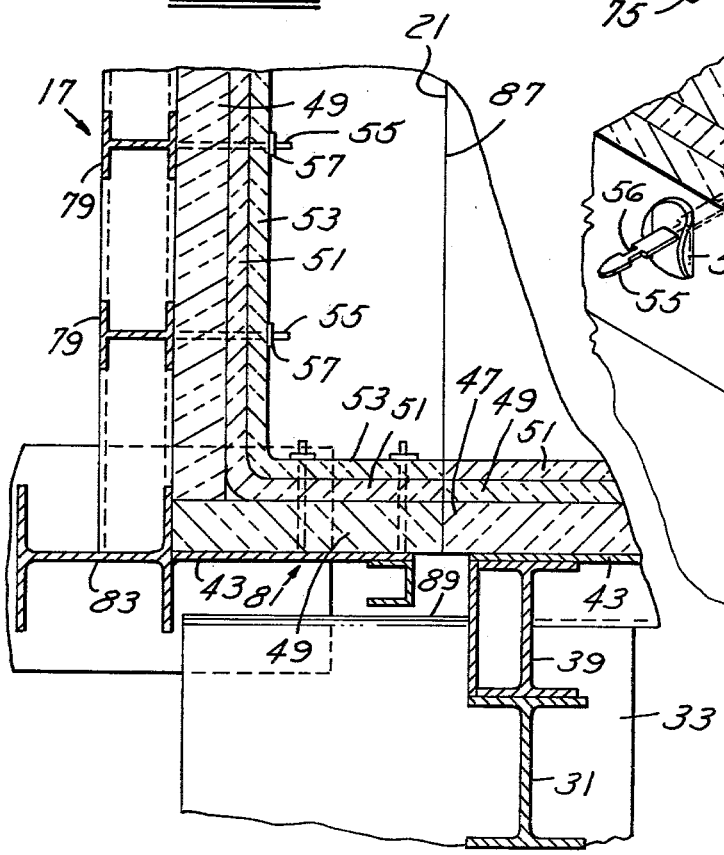
FIG. 7 is a fragmentary plan section taken in the direction of arrows 7—7 of FIG. 6.

When the gantry housing 19 is in the closed position, FIGS. 3, 6 and 7, with respect to the bulkhead 17, the corresponding base portions, side walls and top wall are in opposing registry with those walls of the housing to establish a seal therebetween, as at 87, FIG. 7.

In such closed position, the corresponding wheel housings 33 move so as to overlap and project laterally outward of the sides of said bulkhead, as at 89, FIG. 7.

Arranged upon the outer surface of bulkhead 17 is a transverselyextending exhaust flue 91 having a series of refractory layers 95 and internal transverse exhaust passage 93.

The exhaust passage 93 at its upper end extends towards the bulkhead top wall 97 and is adapted for connection to a suitable chimney for exhausting to atmosphere. Alternately, the flue may be connected to suitable heat exchangers within a building to utilize some of the exhaust heat for the interior of the building before escaping to atmosphere.

As further shown in FIG. 3, the top 97 of the bulkhead underlies the transverse I-beam 99 and adjacent upright I-beams 79 completing the bulkhead construction.

Mounted upon the side walls of the gantry housing for the furnace and arranged adjacent to the top surface of the bed 15 are a pair of vertically spaced rows of spaced burners 101, which in the illustrative embodiment, are gas burners. Each burner includes mounting plate 103, FIG. 10, which is mounted upon the outside surface of the side walls of the housing and secured to the steel sheeting 43 by fasteners 105.

The ceramic or tile burner head 107 is secured to and extends laterally inward of the mounting plate, through the layers or strips of blanket insulation 49, 51 and 53 and partly into the interior chamber of the housing. Said head includes the nozzle or throated combustion chamber 109 which is in communication with the asperator mixer 111 or similar air and fuel mixing device. On the exterior of the side walls of said housing and applied to the asperator mixer is the adjustable gas valve 113 with gas inlet pipe 115 and the adjustable air inlet valve 117 with air inlet pipe 119. Accordingly, gas under a predetermined regulated pressure and compressed air under a predetermined pressure are directed to the asperator mixer 111 and in predetermined proportions as determined are delivered to the nozzle 109 for combustion and for directing heating flame into the interior of said housing.

Applied to the closed end or rear wall 23 of the furnace housing is a stationary gas or fuel intake pipe 121 which is adapted to deliver gas or other fuel through the pairs of gas or fuel distribution pipes 141 which extend along opposite side walls of the housing as in FIG. 1.

Since the gantry housing is retractable, the source of fuel under pressure such as gas, must include a flexible connection for the supply of said gas. For this purpose, there are provided a pair of flexibly connected goose-neck pipe sections 125 as in FIGS. 4, 5 and 6, which are in communication with each other and which are swivelly interconnected as at 123. One end of one of the goose-neck pipe sections 125 is swivelly connected as at 123 to the stationary gas inlet pipe 121. The other end of the other goose neck pipe section 125 is connected as at 127 to a source of gas under pressure.

The inverted U-shaped bracket 129, FIG. 4, overlies the swivel connection 123 between the goose neck pipe sections 125 and is secured thereto. One end of cable 131 is secured to said bracket, and extends around the pulley 133 and at its lower end mounts a counterweight 135.

The pulley is journalled upon the trolley conveyor 137 whose opposed wheels 138 are movably positioned and supported upon the I-beam 139 which is arranged outwardly of and parallel to the housing 19 and secured to the ceiling C, fragmentarily shown.

Thus, FIGS. 5 and 6 show that the gas supply conduits 125 are flexible, depending upon the longitudinal position of the gantry housing 19 upon the tracks 13. The pivotal connection between the goose neck pipes 125 is yieldably supported by the trolley conveyor movable along the length of the ceiling I-beam 139.

By this construction, the source of gas or other fuel under pressure at 127 is delivered through the communicating pipe sections 125, couplings 123 and the stationary gas intake pipe 121 and through the horizontally disposed elongated gas distribution pipes 141, FIGS. 1 and 4.

The gas distribution pipe transmits the gas through the interconnected gas pressure regulators 143 to the respective elongated gas manifold pipes 145 arranged upon opposite sides of the housing intermediate the height thereof and suitably bracketed thereto.

Connected to the respective gas manifold pipes 145 are a series of depending gas delivery pipes 115 which connect the gas inlet valves 113 to the respective gas burners in the manner shown in FIGS. 1 and 10.

Accordingly, for each of the gas burners 101 formed in the vertically spaced rows, there is directed from the respective manifold pipes 145 a corresponding conduit 115 for delivering gas under pressure to each of the respective burner mixers 111 upon opposite sides of said housing.

Applied to the end wall 23 of the gantry housing 19 is a compressor 147, power-operated, and connected therewith are a pair of spaced upright air delivery pipes 149. These extend across the top of said housing and terminate in the respective pairs of corresponding upright compressed air delivery pipes 149 along the opposite side walls of said housing and which terminate in the transverse elongated aligned air head pipes 155. These are bracketed or otherwise secured to the side walls of said housing.

Each of the air pipes 149 adjacent the compressor have dampers 151 connected to the exterior controls 153 for regulating the flow of compressed air through said pipes.

A plurality of additional compressed air delivery pipes 119 extend from the respective air head pipes for communication with the adjustable air inlet valves 117, FIGS. 1 and 10, for communication with the air and fuel mixer 111.

Branch gas pipes connect the regulators 143.

Mounted upon the rear wall 23 of the gantry housing is the motor housing and motor 159, which is a reversible motor, having a power take off 161 connected to the adjacent wheel 37 upon track 13. The power take off includes the transverse drive shaft 163 which extends to a secondary power input 165 suitably connected to the other wheel 37 so that upon reversible operation of the motor 159, the wheels will drive the housing along the tracks 113 between the positions shown in FIGS. 5 and 6.

Mounted upon the rear wall of the housing is a suitable control panel 167 and a pair of temperature recorder strip charts 169 for measuring temperature and which are connected to thermo-couples upon the interior of the insulated gantry housing.

In the illustrative embodiment, the furnace is 18 feet wide, 17 feet high and 36 feet long, approximately. This is almost twice the cubic volume of any known existing heat treat furnace. All of the interior walls of the furnace housing as well as the bulkhead have layers of thin wall insulating blankets. The series of rows of spaced high velocity burners extend through the side walls of the housing and through the layers of insulating blankets. The insulating blankets are of high temperature light weight material, which is better than asbestos.

OPERATION

In operation, metal pieces to be heat treated are placed upon the refractory bed 15 with a lift truck or overhead crane or, if small enough, even by hand. In many instances, they are secured with fire brick cribbing or shims for optimum stability.

When the workpieces are all in place upon the refractory bed 15, the gantry housing is moved along the tracks 13 over the work upon bed 15 until the housing makes a tight closure at 87, FIGS. 3 and 7, with respect to the upright transverse bulkhead 17.

The burners 101 are ignited and the heating begins. Control is effected by automatic devices and the temperatures are recorded by the strip charts 169 connected to thermo-couples within said housing. When the heat treating specified for the work has been completed, the cool-down sequence commences. Ultimately, the furnace housing is retracted clear of the bed 15 to permit removal of the work.

By this construction, the loading of the work is directly upon the refractory bed 15 without the hindrance of limitations of the conventional rail car. Accordingly, the work is not subjected to movement when once located and secured upon the bed.

Of primary importance is also that personnel need not enter the furnace before or after heating.

By the elimination of the rail car, the furnace height and weight is, therefore, reduced.

The furnace can be installed on a shop or plant floor without costly special foundations. It can be removed, repaired or relocated with a minimum description of plant operation. The housing itself is constructed so that it can be taken into the plant or out in sections, thereby offering a considerable cost saving-vs-the fixed and built-in traditional furnace.

As secondary benefits, exhaust heat may be taken from ducts incorporated in the refractory bed and can be utilized by a suitable heat exchanger for building and water heating or in other processing equipment.

In geographic areas where tremors or ground movement are a problem, the removable furnace is not vulnerable.

Having described my invention, reference should now be had to the following claims.

I claim:

1. A retractable gantry heat treat furnace comprising an elongated refractory bed mounted upon a floor for supporting metal parts for heat treatment;

a pair of spaced parallel tracks mounted upon the floor upon opposite sides of said bed, and extending longitudinally outward of one end thereof;

an upright bulkhead upon said floor at the other end of said bed transversely thereof;

an upright furnace housing having a closed end and an open end, movably mounted upon said tracks, having a retracted load position outwardly of said bed, and movable to a closed position over and enclosing said bed and sealed against said bulkhead;

said furnace housing including an open framework consisting of spaced pairs of horizontal top and bottom side beams;

a series of spaced inverted U-shaped beams interconnecting said side beams;

a series of upright beams at the closed end of said housing;

a steel sheeting overlying and spanning the interiors of said U-shaped beams and upright beams defining the interior side, end and top walls of said furnace housing;

and a series of flexible insulating blanket strips arranged side by side and extending over and secured to said side, end and top walls.

2. In the retractable gantry heat treat furnace of claim 1, the movable mounting of said housing including pairs of wheels at and depending from opposite ends of said housing registerable with said tracks;

one pair of wheels being power driven.

3. In the retractable gantry heat treat furnace of claim 2, the power drive of said pair of wheels including a reversible motor having a power output mounted upon the closed end of said housing operably connected to said pair of wheels.

4. In the retractable gantry heat treat furnace of claim 1, and a series of spaced inwardly directed burners mounted upon and along said side walls communicating with the interior of said housing, adapted for energization when said housing is in closed position.

5. In the retractable gantry heat treat furnace of claim 4, said burners being arranged in a pair of vertically spaced rows adjacent said bed, and spaced apart in each row along the length of said housing.

6. In the retractable gantry heat treat furnace of claim 5, the burners of said rows being longitudinally staggered, respectively.

7. In the retractable gantry heat treat furnace of claim 4, layers of insulation upon the interior of said side, top and end walls, and upon the interior walls of said bulkhead, said burners extending through said side wall layers of insulation.

8. In the retractable gantry heat treat furnace of claim 7, said bulkhead having a pair of side walls, a top wall and an end wall, and being open at one end;

said walls corresponding to the side, top and end walls of said housing respectively;

the open end of said housing, when in closed position, being in cooperative sealing registry with the open end of said bulkhead.

9. In the retractable gantry heat treat furnace of claim 8, said insulation overlying the interior of said bulkhead walls.

10. In the retractable gantry heat treat furnace of claim 8, a refractory exhaust flue upon the exterior of said bulkhead end wall connectable to a stack;

there being a transversely elongated exhaust outlet through said bulkhead end wall communicating with said flue for the passage of products of combustion therethrough.

11. In the retractable gantry heat treat furnace of claim 7, said layers of insulation being in the form of blanket strips overlying and secured to said walls respectively.

12. In the retractable gantry heat treat furnace of claim 1, said blanket strips being arranged in a plurality of layers.

13. In the retractable gantry heat treat furnace of claim 1, the securing of said insulating blanket strips to said walls including a plurality of spaced rows of spaced anchor clips secured to said framework and projecting through said blanket strips;

and a locking means on each clip retainingly engaging said blanket strips.

14. In the retractable gantry heat treat furnace of claim 1, said blanket strips extending vertically over the housing side walls and horizontally over the housing top and end walls.

15. In the retractable gantry heat treat furnace of claim 1, said blanket strips including a first strip of monobloc-insulating material of predetermined thickness bearing against said steel sheeting, and an additional pair of blanket strips of ceramic material of reduced thickness overlying said first strip.

16. In the retractable gantry heat treat furnace of claim 15, the securing of said insulating blanket strips to said walls including a plurality of spaced rows of spaced anchor clips secured to said framework and projecting through said blanket strips;

and a locking means on each clip retainingly engaging said blanket strips.

17. In the retractable gantry heat treat furnace of claim 4, said burners each including a mounting plate secured to the outside of said housing side walls;

a ceramic head mounted on said plate and extending through said side walls having a throated combustion nozzle opening into said housing;

an asperating fuel and air mixer assembly upon said plate outwardly of said side wall and communicating with said head;

an adjustable gas valve with inlet pipe connected to said mixer assembly;

and an adjustable air valve with inlet pipe connected to said mixer assembly.

18. In the retractable gantry heat treat furnace of claim 4, said burners each including a mounting plate secured to the outside of said housing side walls;

a ceramic head mounted on said plate and extending through said side walls having a burner nozzle opening into said housing;

a gas and air mixer assembly upon said plate communicating with said nozzle;

and adjustable gas and air valves on said mixer assembly having gas and air inlets respectively.

19. In the retractable gantry heat treat furnace of claim 4, said burners including a ceramic head mounted on and extending through said side walls having a nozzle opening into said housing;

adjustable air and gas valves on the exterior of said side walls having air and gas inlets, respectively;

a horizontally disposed elongated gas manifold pipe mounted upon the exterior of each side wall and connected to a source of gas under pressure;

a plurality of conduits at one end connected to said manifold pipe and at its other end connected to the gas inlet of each burner, respectively, a horizontally disposed elongated air head pipe mounted upon the exterior of each side wall and connected to a source of regulated compressed air;

and a plurality of conduits at one end connected to said air head pipe and at its other end to the air inlet of each burner, respectively.

20. In the retractable gantry heat treat furnace of claim 19, said source of regulated compressed air including an air compressor mounted upon said housing end wall, and having a pair of spaced upright delivery pipes extending to the top of said housing, and extending longitudinally over part of the top thereof, and respectively connected to the air head pipes upon said housing side walls.

21. In the retractable gantry heat treat furnace of claim 1, an upwardly opening channel mounted upon the side edges of said bed along its length, including an upright seal flange;

said housing side walls terminating in opposed inwardly directed bases extending toward and spaced from opposite sides of said bed;

and a depending elongated upright edge plate along the inner edge of said bases loosely nested within said bed channels respectively for sealing the interior of said housing from the exterior when the housing is in registry with said bulkhead, and adapted for movement along the length of said channels when said housing is retracted to open position.

22. A retractable gantry heat treat furnace comprising an elongated refractory bed mounted upon a floor for supporting metal parts for heat treatment;

a pair of spaced parallel tracks mounted upon the floor upon opposite sides of said bed, and extending longitudinally outward of one end thereof;

an upright bulkhead upon said floor at the other end of said bed transversely thereof;

an upright furnace housing having a closed end and an open end, movably mounted upon said tracks, having a retracted load position outwardly of said bed, and movable to a closed position over and enclosing said bed and sealed against said bulkhead;

said housing having a pair of side walls, a top wall and an end wall;

a series of spaced inwardly directed burners mounted upon and along said side walls communicating with the interior of said housing, adapted for energization when said housing is in closed position;

said burners including a ceramic head mounted on and extending through said side walls, having a nozzle opening into said housing;

adjustable air and gas valves on the exterior of said side walls having air and gas inlets respectively;

a horizontal elongated gas manifold pipe mounted upon the exterior of said side walls connected to a source of gas under pressure;

a plurality of conduits at one end connected to said manifold pipe and at its other end connected to the gas inlet of each burner respectively;

said source of gas under pressure including a fixed gas inlet mounted upon the exterior of said housing end wall and connected to said gas manifold pipes;

a pair of communicating goose neck pipe sections at their one ends pivotally interconnected, the other end of one pipe section being pivotally connected to said fixed gas inlet; the other end of said other pipe section being connected to a source of gas under pressure;

a ceiling overlying said housing;

an I-beam secured to said ceiling outwardly of and parallel to one side wall of said housing;

a trolley conveyor movably mounted upon said I-beam and supporting a pulley;

and a weighted cable extending over said pulley and at one end, connected to the pivotal connection of said gas pipe sections, for movably supporting said gas pipe sections during reciprocal movements of said furnace housing.

23. A retractable heat treat furnace comprising an elongated refractory bed mounted upon a floor for supporting metal parts for heat treatment;

a pair of spaced parallel tracks mounted upon the floor upon opposite sides of said bed, and extending longitudinally outward of one end thereof;

an upright bulkhead upon said floor at the other end of said bed transversely thereof;

an upright furnace housing having a closed end and an open end, movably mounted upon said tracks, having a retracted load position outwardly of said bed, and movable to a closed position over and enclosing said bed and sealed against said bulkhead;

said housing having a pair of side walls, a top wall and an end wall;

a series of spaced inwardly directed burners mounted upon and along said side walls communicating with the interior of said housing, adapted for energization when said housing is in closed position;

said burners including adjustable air and gas valves upon the exterior of said side walls having air and gas inlets respectively;

a horizontally elongated gas manifold pipe mounted upon the exterior of each side wall connected to a source of gas under pressure;

a plurality of conduits at one end connected to said manifold pipe and at its other end, connected to the gas inlets of each burner respectively;

said source of gas under pressure including a fixed gas inlet mounted upon the exterior of said housing end wall and connected to said gas manifold pipes;

a pair of communicating goose neck pipe sections at their one ends pivotally interconnected, the other end of one pipe section being pivotally connected to said fixed gas inlet; the other end of said other pipe section being connected to a source of gas under pressure;

a ceiling overlying said housing;

an I-beam secured to said ceiling outwardly of and parallel to one side wall of said housing; and a trolley conveyor movably mounted upon said I-beam and adjustably supporting the pivotal connection between said goose neck gas pipe sections during reciprocal movements of said furnace housing.

* * * * *